US010791861B2

(12) United States Patent
Heller

(10) Patent No.: US 10,791,861 B2
(45) Date of Patent: Oct. 6, 2020

(54) SHOE COVER REMOVAL APPARATUS

(71) Applicant: Robert Heller, Knoxville, TN (US)

(72) Inventor: Robert Heller, Knoxville, TN (US)

(73) Assignee: Protexer Corporation, Knoxville, TN (US)

( * ) Notice: Subject to any disclaimer, the term of this patent is extended or adjusted under 35 U.S.C. 154(b) by 1650 days.

(21) Appl. No.: 14/046,222

(22) Filed: Oct. 4, 2013

(65) Prior Publication Data

US 2014/0231470 A1 Aug. 21, 2014
US 2019/0104875 A9 Apr. 11, 2019

Related U.S. Application Data

(63) Continuation-in-part of application No. 13/192,145, filed on Jul. 27, 2011, now abandoned, and a continuation of application No. 12/852,070, filed on Aug. 6, 2010, now abandoned, and a continuation-in-part of application No. 12/412,095, filed on Mar. 26, 2009, now abandoned.

(60) Provisional application No. 61/039,681, filed on Mar. 26, 2008.

(51) Int. Cl.
*A47G 25/80* (2006.01)
*A47G 25/90* (2006.01)

(52) U.S. Cl.
CPC ..... *A47G 25/80* (2013.01); *A47G 25/907* (2013.01); *A47G 25/908* (2013.01); *A47G 25/905* (2013.01)

(58) Field of Classification Search
CPC .... A47G 25/80; A47G 25/905; A47G 25/907; A47G 25/908
USPC ..... 15/301–318.1
See application file for complete search history.

(56) References Cited

U.S. PATENT DOCUMENTS

| | | | |
|---|---|---|---|
| 1,359,193 | A | 11/1920 | Parker |
| 2,304,193 | A | 12/1942 | Nielsen |
| 2,718,655 | A | 9/1955 | Cymara |
| 2,724,856 | A | 11/1955 | Conkey |
| 2,895,159 | A | 7/1959 | Ostrow |
| 2,963,723 | A | 12/1960 | Nappi |
| 3,044,099 | A | 7/1962 | Scott |
| 3,048,867 | A | 8/1962 | Counts |

(Continued)

FOREIGN PATENT DOCUMENTS

| | | |
|---|---|---|
| GB | 2446669 | 8/2008 |
| JP | 09117301 | 5/1997 |

(Continued)

*Primary Examiner* — David Redding
(74) *Attorney, Agent, or Firm* — Luedeka Neely Group, P.C.

(57) ABSTRACT

An apparatus which includes a trough for receiving a user's shoe. The trough includes a removal portal. The apparatus includes a vacuum capable of causing a shoe cover to be removed from the shoe of a user when a user places a shoe covered by a shoe cover into the trough. An actuator is triggered by the placement of an object in the trough, the triggering of the actuator causing the vacuum to activate. The vacuum activation causes the shoe cover to be sucked through the removal portal and into a primary chamber. The primary chamber collects the removed shoe covers and is disposed in a remote from the trough for preventing debris and other contaminants from being stored in a clean room. The apparatus may also include multiple troughs connected to one or more primary chambers.

7 Claims, 13 Drawing Sheets

(56) References Cited

U.S. PATENT DOCUMENTS

| | | | | |
|---|---|---|---|---|
| 3,066,338 | A | 12/1962 | Nappi | |
| 3,115,653 | A | 12/1963 | Fresh | |
| 3,445,875 | A | 5/1969 | Bohannon | |
| 3,626,545 | A | 12/1971 | Sparrow | |
| 3,737,942 | A | 6/1973 | Casey | |
| 3,775,793 | A | 12/1973 | Casavant | |
| 4,024,599 | A | 5/1977 | Gamboa | |
| 4,724,564 | A * | 2/1988 | Fresh | A47L 23/263 15/311 |
| 4,922,578 | A | 5/1990 | Miettinen | |
| 5,083,704 | A | 1/1992 | Rounthwaite | |
| 5,384,933 | A | 1/1995 | Wang | |
| 5,588,175 | A | 12/1996 | Zahner | |
| 5,655,253 | A | 8/1997 | Nevin | |
| 5,940,926 | A | 8/1999 | Inzinna | |
| 5,991,967 | A | 11/1999 | Williams | |
| 6,067,688 | A * | 5/2000 | West | A47L 23/263 15/311 |
| 6,105,201 | A * | 8/2000 | Min | A47L 23/263 15/302 |
| 6,434,784 | B1 | 8/2002 | Wisser | |
| 6,499,171 | B2 | 12/2002 | Nappi | |
| 6,532,686 | B2 | 3/2003 | Gultekin | |
| 6,543,075 | B2 | 4/2003 | Gultekin | |
| 6,668,842 | B1 | 12/2003 | Wilke | |
| 6,691,939 | B2 | 2/2004 | Grimes | |
| 7,676,876 | B1 | 3/2010 | Ewert | |
| 7,793,384 | B1 | 9/2010 | Kerr | |
| 8,092,564 | B2 * | 1/2012 | Totsugi | A47L 9/281 15/301 |
| 8,533,901 | B2 * | 9/2013 | Williams | A47L 23/263 15/303 |
| 2002/0020031 | A1 | 2/2002 | Gultekin | |
| 2004/0177467 | A1 | 9/2004 | Jones | |
| 2004/0244337 | A1 | 12/2004 | Asici | |
| 2005/0050669 | A1 | 3/2005 | Castello | |
| 2007/0011841 | A1 | 1/2007 | Kao | |
| 2007/0163912 | A1 | 7/2007 | Chen | |
| 2007/0234690 | A1 | 10/2007 | Ryan | |
| 2007/0271723 | A1 | 11/2007 | Junell | |
| 2008/0173658 | A1 * | 7/2008 | Ronning | B65D 25/005 220/825 |
| 2009/0071989 | A1 * | 3/2009 | He | A43B 3/16 223/111 |
| 2009/0152312 | A1 | 6/2009 | Li | |

FOREIGN PATENT DOCUMENTS

| | | |
|---|---|---|
| JP | 2006094990 | 4/2006 |
| KR | 100675956 | 2/2007 |
| KR | 100913617 | 8/2009 |
| WO | WO9116829 | 11/1991 |
| WO | WO2007122682 | 3/2005 |
| WO | WO2009100634 | 8/2009 |

* cited by examiner

SHOE COVER REMOVAL APPARATUS

CROSS REFERENCE TO RELATED APPLICATIONS

This application claims priority as a continuation of co-pending U.S. patent application Ser. No. 12/852,070 and as a continuation-in-part of co-pending U.S. patent application Ser. No. 13/192,145 and as a continuation-in-part of co-pending U.S. patent application Ser. No. 12/412,095, filed Mar. 26, 2009, which claims priority under 35 U.S.C. § 119(e) to provisional application Ser. No. 61/039,681, filed Mar. 26, 2008, all of which are incorporated herein by reference in their entirety.

FIELD

This invention relates to the field of automated show covering devices. More particularly, this invention relates to an apparatus for automatically removing shoe covers.

BACKGROUND

The outer surfaces of shoes collect many undesirable substances such as dirt and mud while worn by a person on any given day. Many industries such as construction, farming, and manufacturing involve work environments in which the collection of undesirable materials on shoes is particularly substantial. The collection of such substances on shoes and the subsequent transfer of such substances to the interior of homes, buildings, or other structures by foot traffic is undesirable and may raise concerns regarding the cleanliness of the interior of such structures. Shoes may be removed before entering a home, building, or other similar structure to avoid such problems. However, in environments where such a practice of removing shoes from feet before entering such structures is not common or otherwise impractical, shoe coverings are often used.

Disposable shoe covers are commonly employed to avoid the need for persons to remove their shoes before entering homes, buildings, or other structures. However, placing shoe covers on shoes (particularly, unclean shoes) is inconvenient and may require a person to use hands to place a shoe cover over a shoe, thereby exposing the user's hands to the substances on the shoe. In addition to adding shoe covers to the feet or shoes of a user, the shoe covers that are put on must be removed. Therefore, there is a need for a mechanically reliable and simplified automatic shoe cover removal apparatus that is capable of automatic removal of a shoe cover from a user's shoe.

Additionally, there is need to perform the automatic removal of shoe covers in a manner that leaves little or no dirt, dust, germs, bacteria, fungus, viruses, toxins, drugs, small particulate matter, and/or other contaminants near or around the shoe cover removal apparatus. For example, certain activities in certain industries require what are often referred to as "clean rooms." Often, shoe covers are used in a clean room and then must be removed in the clean room, because much of the work done in clean rooms includes the handling of materials (both non-living and living) that is desirably kept isolated and contained in such clean rooms. In some applications of an automatic shoe cover remover, it is desirable to prevent debris, such as dust, ash, and other small particulate matter from being blown out of the automatic shoe remover into an enclosed area thereby dirtying or otherwise contaminating the area. Also, in some applications it is desirable to prevent the debris on the removed shoe covers collected and stored by the shoe cover remover from further contaminating the clean area.

What is needed, therefore, is an apparatus capable of efficiently removing a shoe cover from the appendage of a wearer. Additionally, it is desirable that such a device does not contaminate the area around the removal apparatus with materials located on the removed shoe cover.

SUMMARY

The above and other needs are met by apparatus which includes a trough for receiving a user's shoe. The trough includes a removal portal. The apparatus includes a vacuum with a motor, a suction portal, and an exhaust portal, where the vacuum is capable of causing a shoe cover to be removed from the shoe of a user when a user places a shoe covered by a shoe cover into the trough. An actuator is triggered by the placement of an object in the trough, the triggering of the actuator causing the vacuum to activate. The vacuum activation causes the shoe cover to be sucked through the removal portal and into a primary chamber. The primary chamber receives the removed shoe covers and includes a primary chamber input portal, and a primary chamber output portal. The primary chamber is disposed in a remote location with respect to the trough.

In another embodiment of the invention, the apparatus includes a first trough for receiving a user's shoe, the first trough including a first removal portal, and a second trough for receiving a user's shoe, the second trough including a second removal portal. The apparatus includes a vacuum with a motor, a suction portal, and an exhaust portal, where the vacuum is capable of causing a shoe cover to be removed from the shoe of a user when a user places a shoe covered by a shoe cover into one of the troughs. An actuator is triggered by the placement of an object in one of the troughs, the triggering of the actuator causing the vacuum to activate. The vacuum activation causes the shoe cover to be sucked through the removal portal and into a primary chamber. The primary chamber receives the removed shoe covers and includes a primary chamber input portal, and a primary chamber output portal.

In yet another embodiment, the apparatus includes a plurality of troughs for receiving a user's shoe, the plurality of troughs each including a removal portal and an actuator triggered by the placement of an object in the trough. The apparatus includes a vacuum with a motor, a suction portal, and an exhaust portal. A primary chamber is disposed remotely from the plurality of troughs. The primary chamber includes a lid, a primary chamber input portal, and a primary chamber output portal. The primary chamber input portal is connected to the removal portal and the primary chamber output portal is connected to the suction portal. A porous collection container is removably located in the primary chamber, the collection container for collecting removed shoe covers. The triggering of one of the actuators causes the vacuum to activate, wherein the activation of the vacuum is capable of causing a shoe cover to be removed from the shoe of a user when a user places a shoe covered by a shoe cover into one of the troughs, whereby such shoe cover is sucked through the removal portal and into the primary chamber.

BRIEF DESCRIPTION OF THE DRAWINGS

Further features, aspects, and advantages of the present invention will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Figure 1:
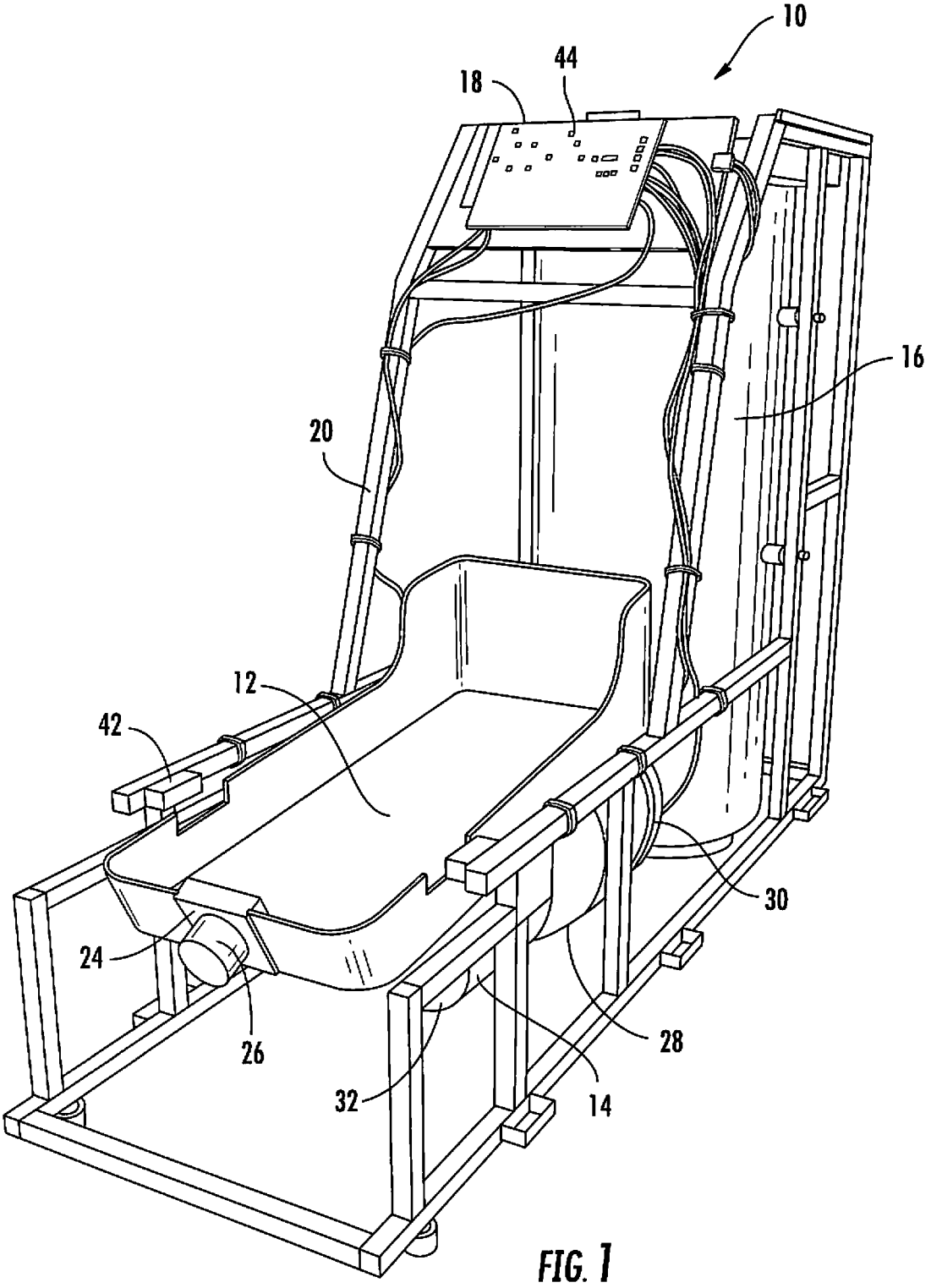
FIG. 1 shows a perspective front view of a shoe cover removal apparatus according to an embodiment of the invention.

FIG. 1 shows one embodiment of an apparatus 10 for removing a shoe cover from the shoe of a user. As shown in FIGS. 1-7, the apparatus includes a trough 12, a vacuum device 14, a primary chamber 16, and an actuator 18. The embodiment shown in FIGS. 1-7 includes a frame 20 for supporting and attaching various parts of the apparatus together to form a robust device. The primary chamber includes a lid 22 that, in this embodiment, is manually movable to an open position (shown in FIG. 4) or a closed position. The primary chamber is preferably cylindrical, although other shapes are contemplated by the invention.

Figure 2:
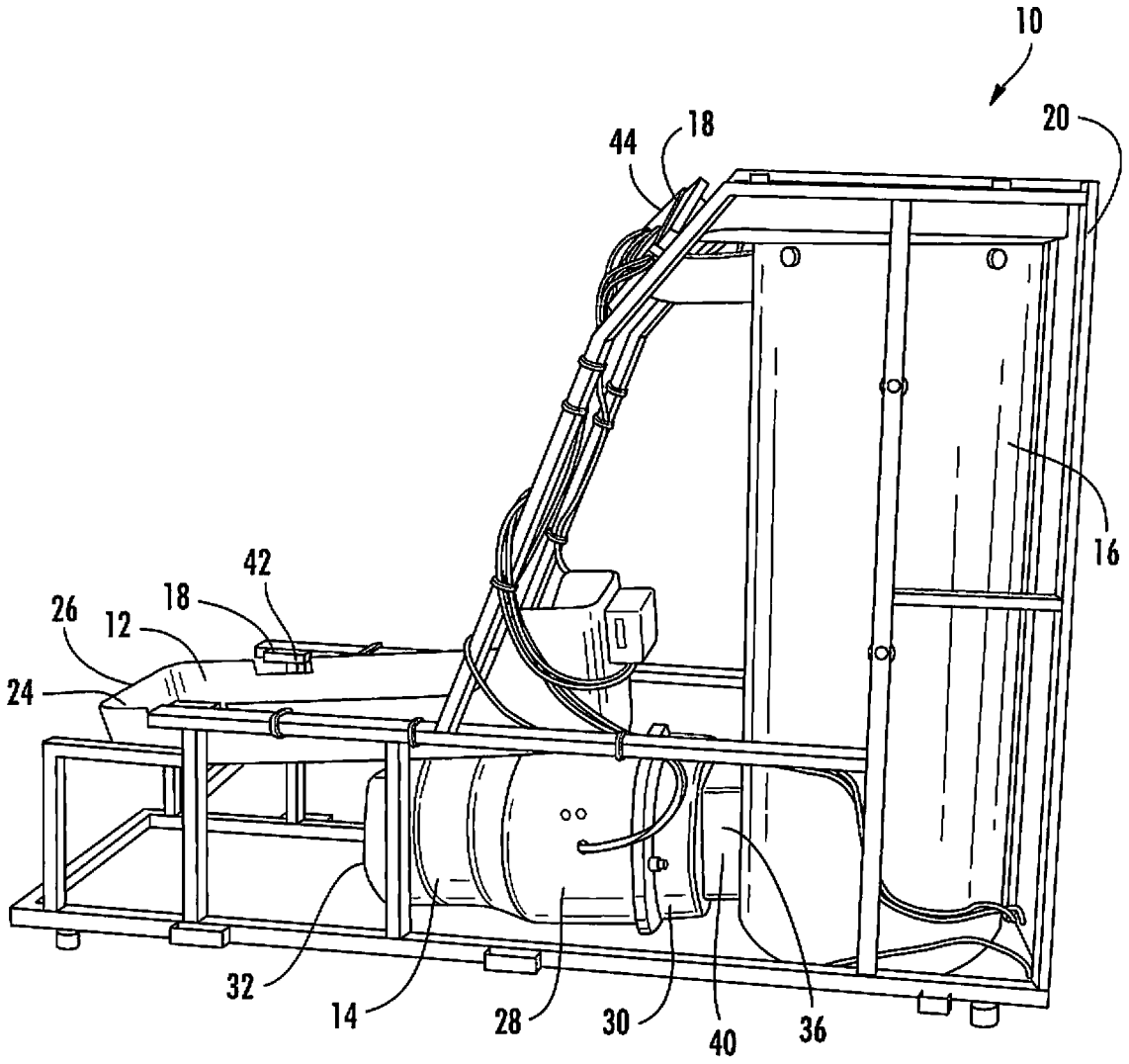
FIG. 2 shows a perspective side view of a shoe cover removal apparatus according to an embodiment of the invention.
Figure 3:
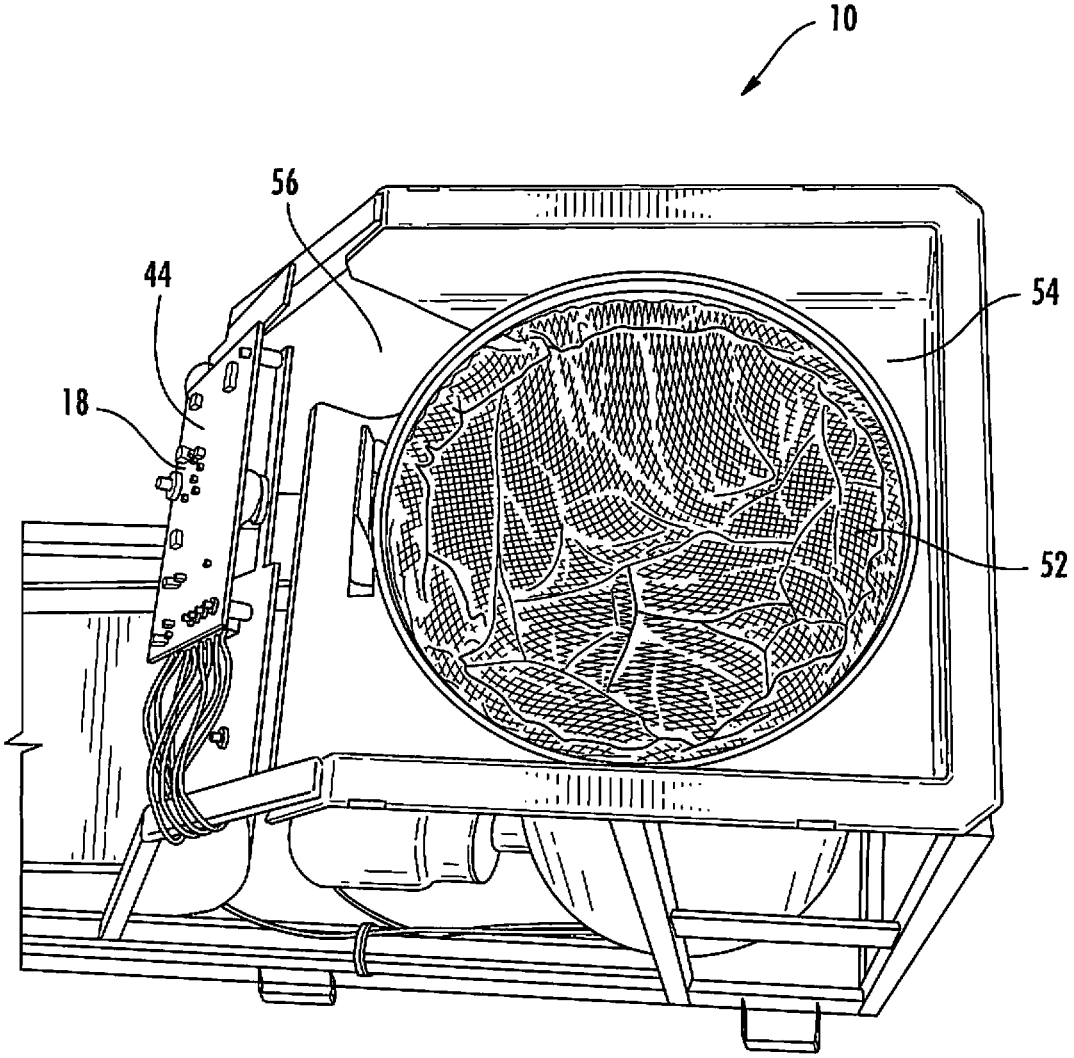
FIG. 3 shows a top view of a shoe cover removal apparatus according to an embodiment of the invention.

The trough 12 includes a removal portal 24 including a gasket 26. The vacuum device 14 includes a motor 28, a suction portal 30 and an exhaust portal 32. The motor 28 is preferably approved by Underwriters Laboratories, Inc. The motor 28 may be a bypass motor having a dual fan arrangement. The dual fan arrangement includes a first fan that sucks air through the suction portal 30 causing a main air flow and a second fan that draws air from outside the bypass motor for cooling the motor 28 and causing a cooling air flow. The bypass motor is configured so that the main air flow and cooling air flow is separate. In certain embodiments, a filter, preferably a high efficiency particulate air (HEPA) filter, is included at the cooling air flow outlet for removing debris and other contaminants from the air used to cool the bypass motor. The primary chamber 16 includes an input portal 34 and an output portal 36. The removal portal 24 is connected to the input portal 34 of the primary chamber 16. The output portal 36 of the primary chamber 16 is connected to the suction portal 30 of the vacuum device 14. In the embodiment shown in FIG. 7, the removal portal 24 is connected to the input portal 34 via a flexible hose 38. As shown in FIG. 2, the output portal 36 is connected to the suction portal 30 directly by connector 40. All of these connections are preferably substantially hermetically sealed when the vacuum is activated.

The actuator 18 in the embodiment shown in FIGS. 1-7 includes a detection system that further includes at least one detection sensor 42 for detecting when a user places an object in the trough, preferably using infrared light detection. In alternate embodiments, the detection sensor 42 could be a pressure sensor or other suitable sensors. The system also includes a circuit board 44 with control logic. The circuit board is preferably approved by Underwriters Laboratories, Inc. The actuator 18 activates the vacuum device 14. Thus, when a user wearing a shoe with a shoe cover places the shoe into the trough, the sensor 42 sends a signal to the circuit board 44, and the circuit board 44 and associated control logic causes power to flow to the vacuum motor 28. After the motor 28 is turned on, a vacuum is created within the trough 12 at the removal portal, such that the shoe cover is removed from the shoe of the user and sucked into the removal portal 24 and to the primary chamber 16 where shoe covers may be collected. In a preferred embodiment, the vacuum device 14 shuts off when a user removes the shoe from the trough. In alternate embodiments, the vacuum device 14 shuts off automatically after a pre-determined period of time programmed in the control logic. In certain embodiments, the apparatus 10 also includes a manual override control that is capable of cutting power to the vacuum device 14.

Figure 4:
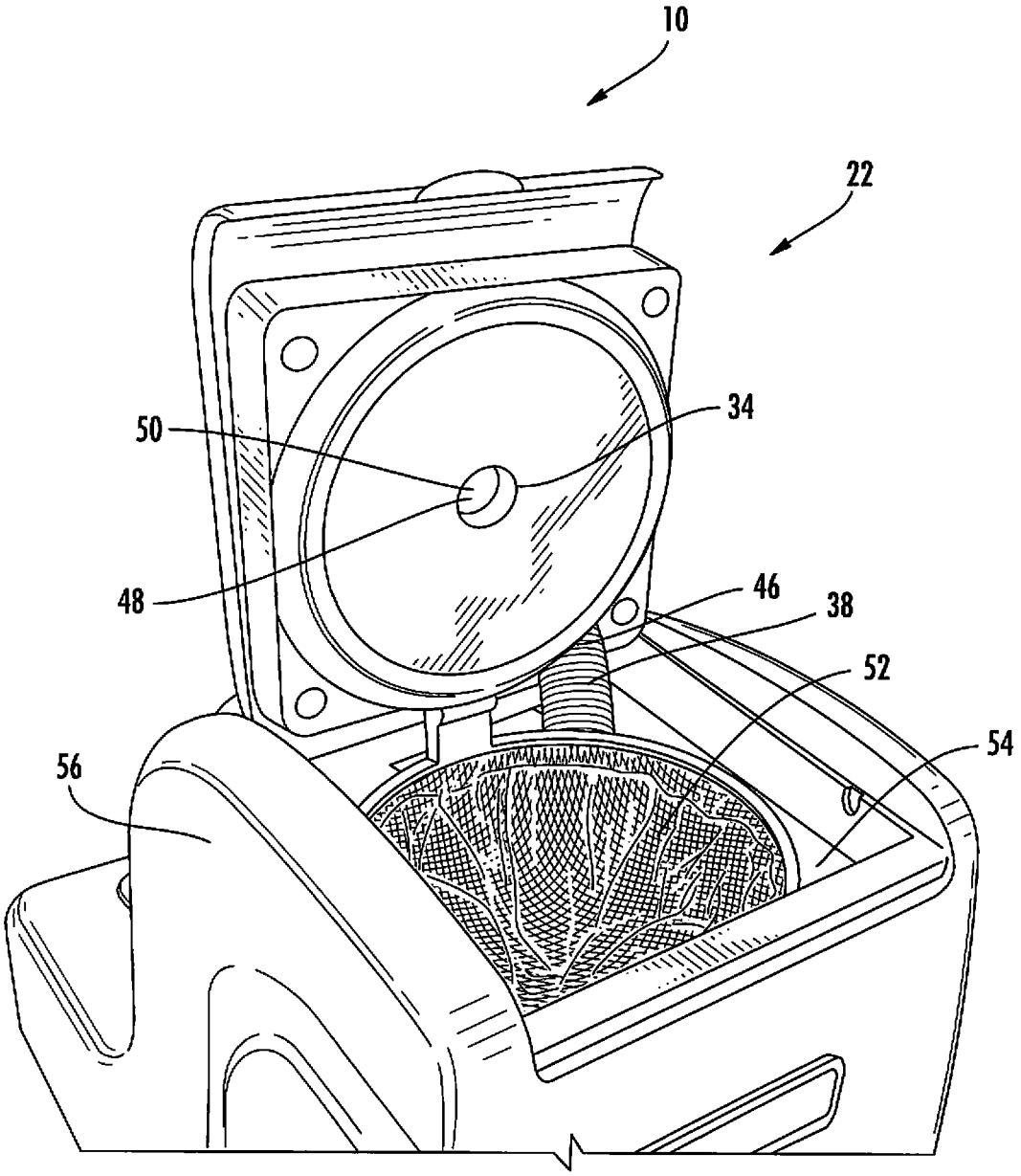
FIG. 4 shows a perspective top view of a shoe cover removal apparatus according to an embodiment of the invention.
Figure 5:
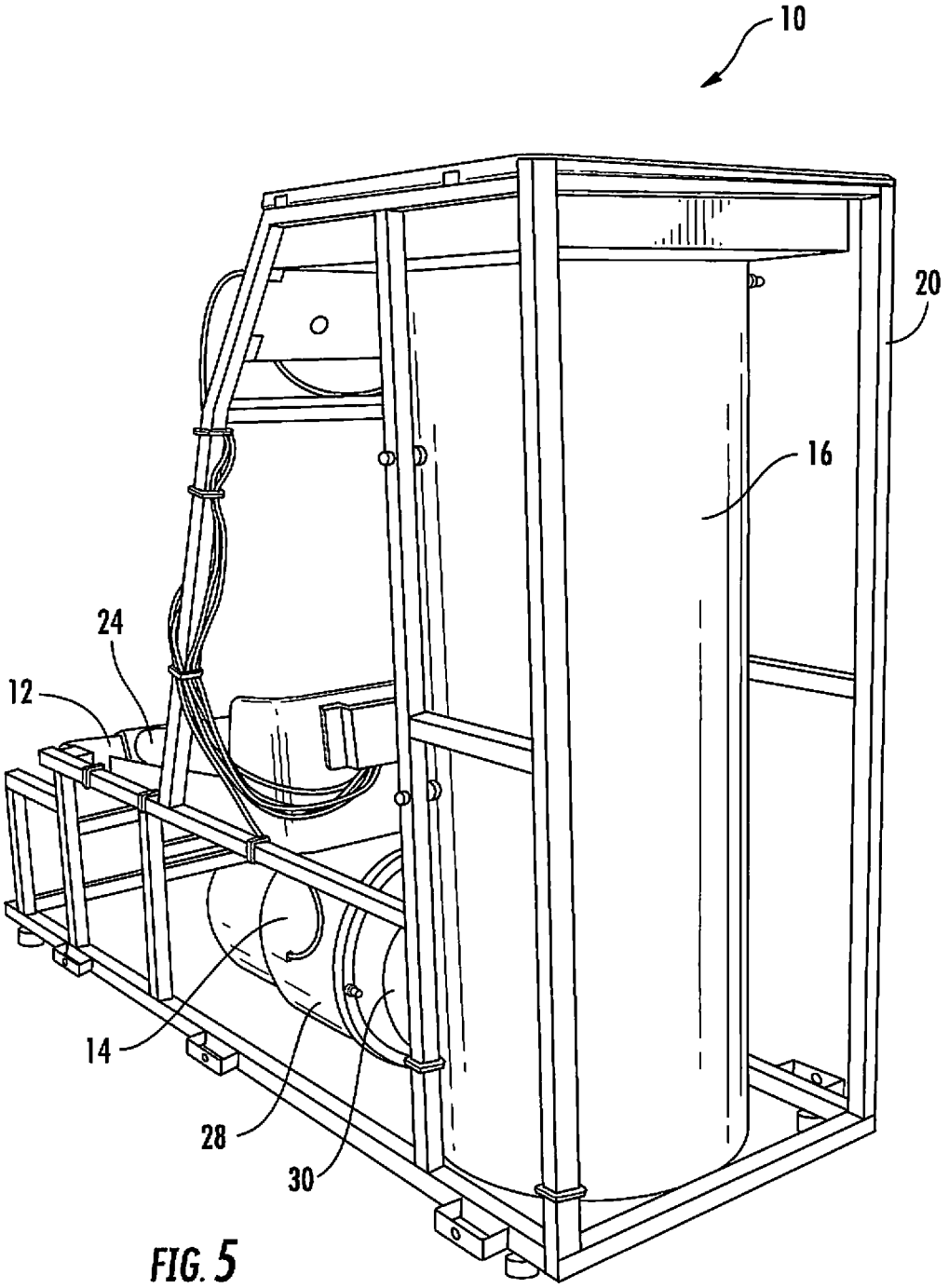
FIG. 5 shows a perspective rear view of a shoe cover removal apparatus according to an embodiment of the invention.
Figure 6:
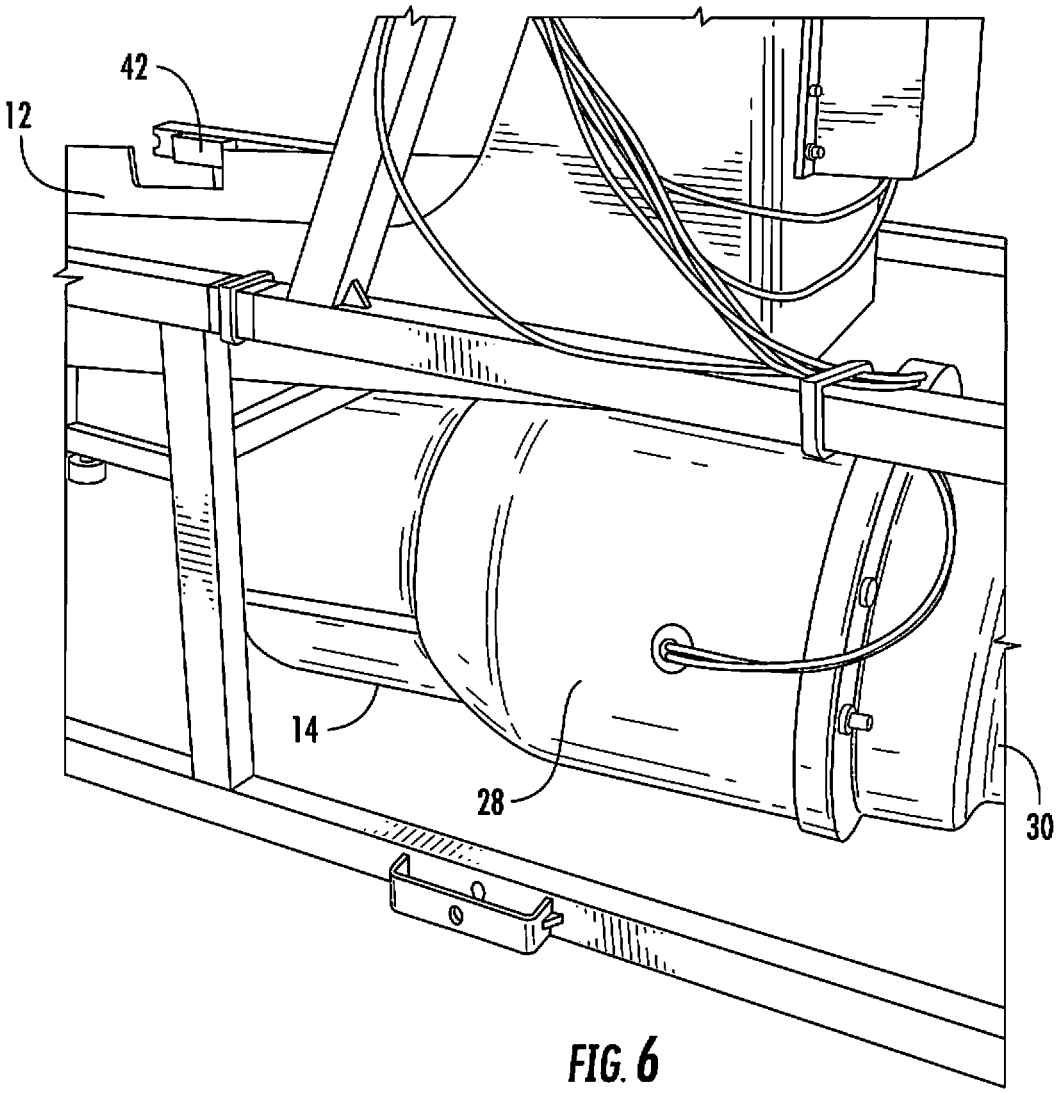
FIG. 6 shows a close-up view of the vacuum of a shoe cover removal apparatus according to an embodiment of the invention.

In the embodiment shown in FIG. 4, the input portal is located along the lid 22. Hose 38 may connect to a lid input portal 46. The lid 22 further includes a lid chamber 48. Air, shoe covers, and anything else being pulled through the apparatus 10 may exit the lid chamber 48 via the lid output portal 50 which, in this embodiment, also acts as the primary chamber input portal 34. The apparatus 10 preferably includes a collection container 52 that fits within the primary chamber 16. The collection container 52 is porous, allowing for air to flow through the container 52 but prohibiting shoe covers from escaping the container 52. The container 52 may be removed from the primary chamber 16 when the lid 22 is in an open position, thereby facilitating the removal of shoe covers from the apparatus 10. The embodiment shown in FIGS. 3-4 includes a cover plate 54 attached to the frame 20. The cover plate 54 preferably includes a notch 56 allowing for hose 38 to fit through the cover plate 54 to keep the apparatus 10 more compact. Container 52 is preferably a mesh bag. The mesh container 52 is preferably connected to a rigid circular ring which removably rests in a notch in the cover plate 54. In alternate embodiments, the mesh container may be removably connected to the cover plate using other mechanisms. One alternative or addition to using a mesh container 52 is to use a screen 53 (see FIG. 11) to hinder larger materials (including shoe covers) from being sucked through the output portal 36.

Figure 9:
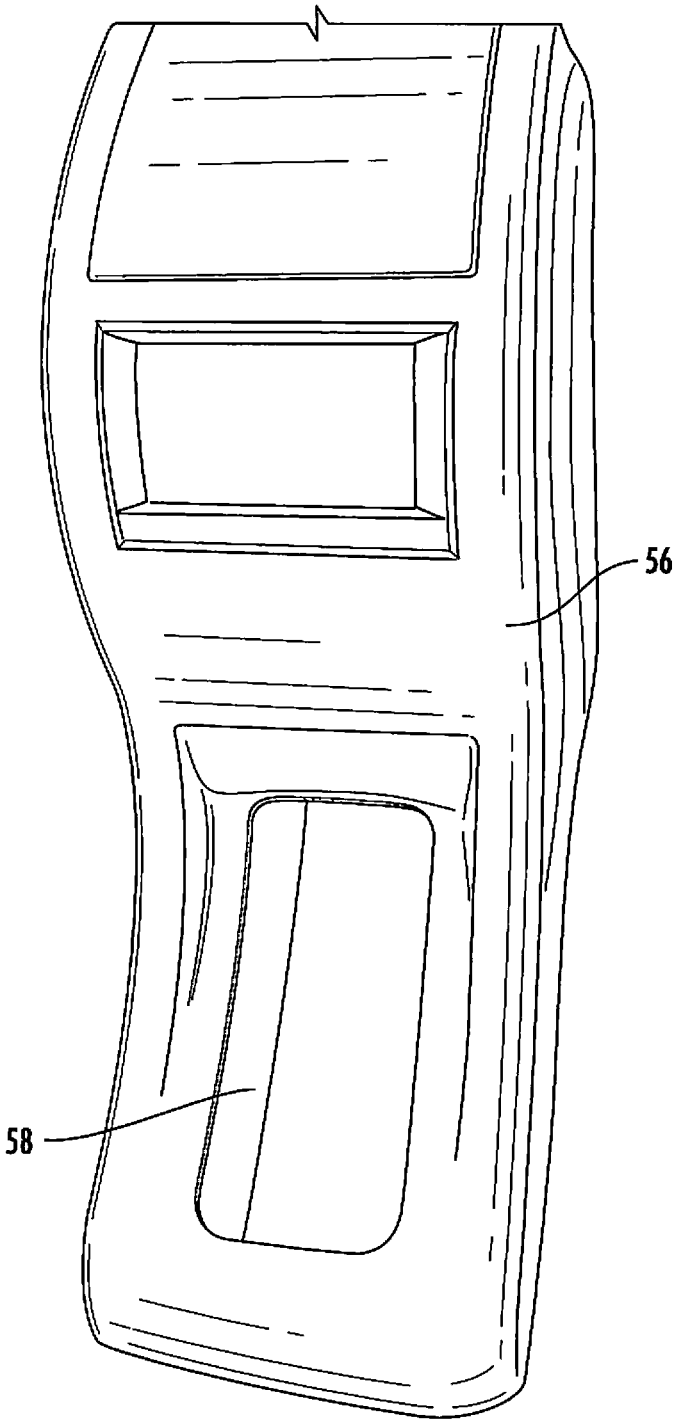
FIG. 9 shows a top perspective view of a shell of a shoe cover removal apparatus according to an embodiment of the invention.

FIG. 9 shows a shell 56 that may be placed over the frame 20 for aesthetic and other purposes. Shell 56 includes a trough aperture 58 so that the trough 12 is not covered by the shell 56. The Shell may be sized and shaped as needed to conform to the dimensions of a particular frame.

Figure 10:
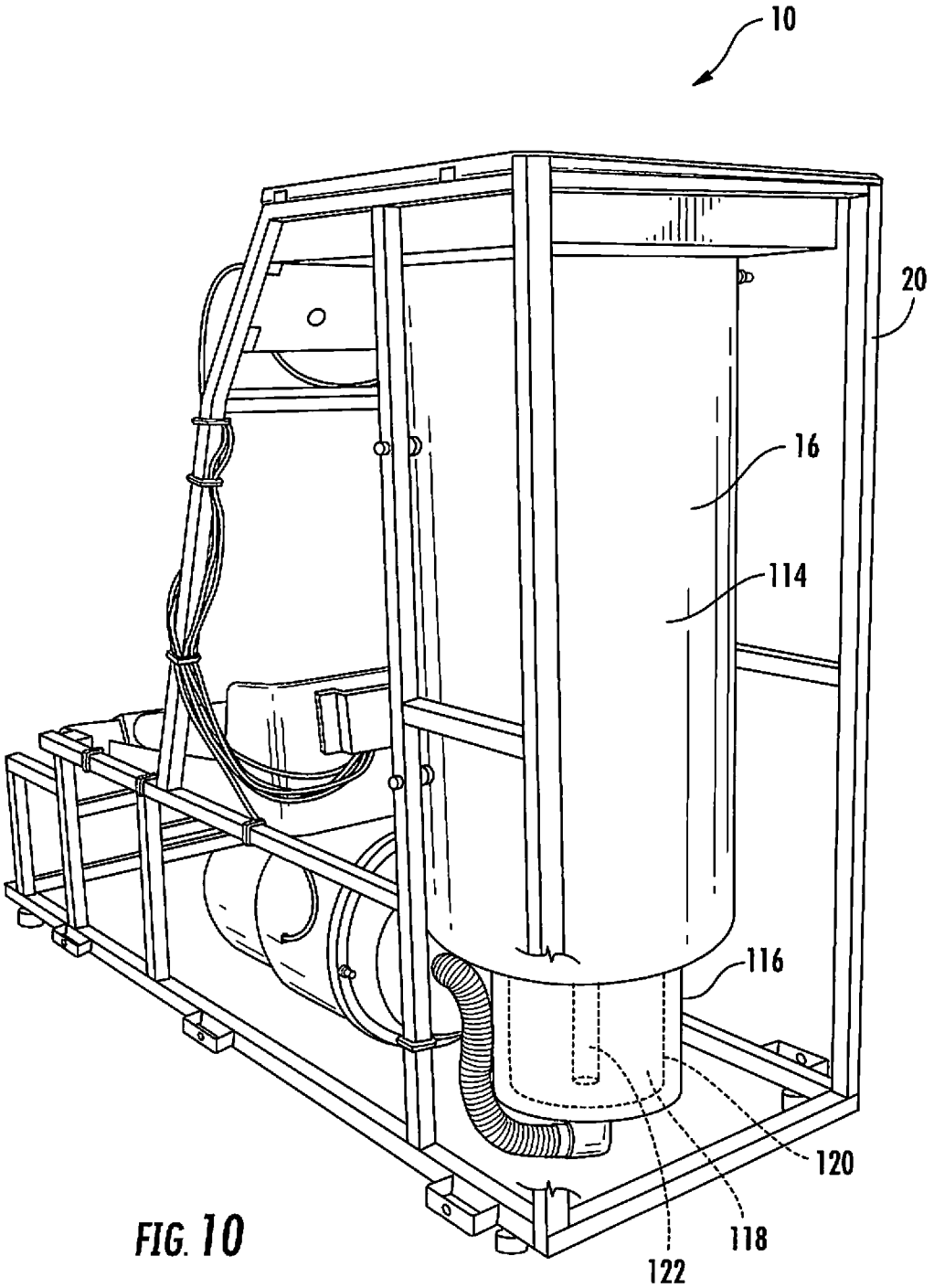
FIG. 10 shows a perspective rear view of a shoe cover removal apparatus including a first sub-chamber and a second sub-chamber according to an embodiment of the invention.

Some applications of the shoe cover removal apparatus 10 require a very high degree of cleanliness. For these and other situations, apparatus 10 may have a primary chamber 16 which is sub-divided into a first sub-chamber 114 and a second sub-chamber 116. The first sub-chamber 114 is for receiving removed shoe covers and, in some embodiments, a housing collection container 52. The second sub-chamber 116 is for housing a filter 118, preferably a high efficiency particulate air (HEPA) filter, to remove dirt, dust, germs, bacteria, fungus, viruses, toxins, drugs, small particulate matter, and other contaminants from the materials being sucked through the container 52 and/or screen 53. In the embodiments shown in FIGS. 10-13, the filters to be used would preferably be cylindrical, filtering laterally from the outside cylindrical perimeter surface 120 of the filter to an interior channel 122. In the embodiment shown in FIG. 10, the output portal 36 of the primary chamber 16 is substantially hermetically connected to the suction portal 30 of the vacuum device 14 via tube 125.

Figure 11:
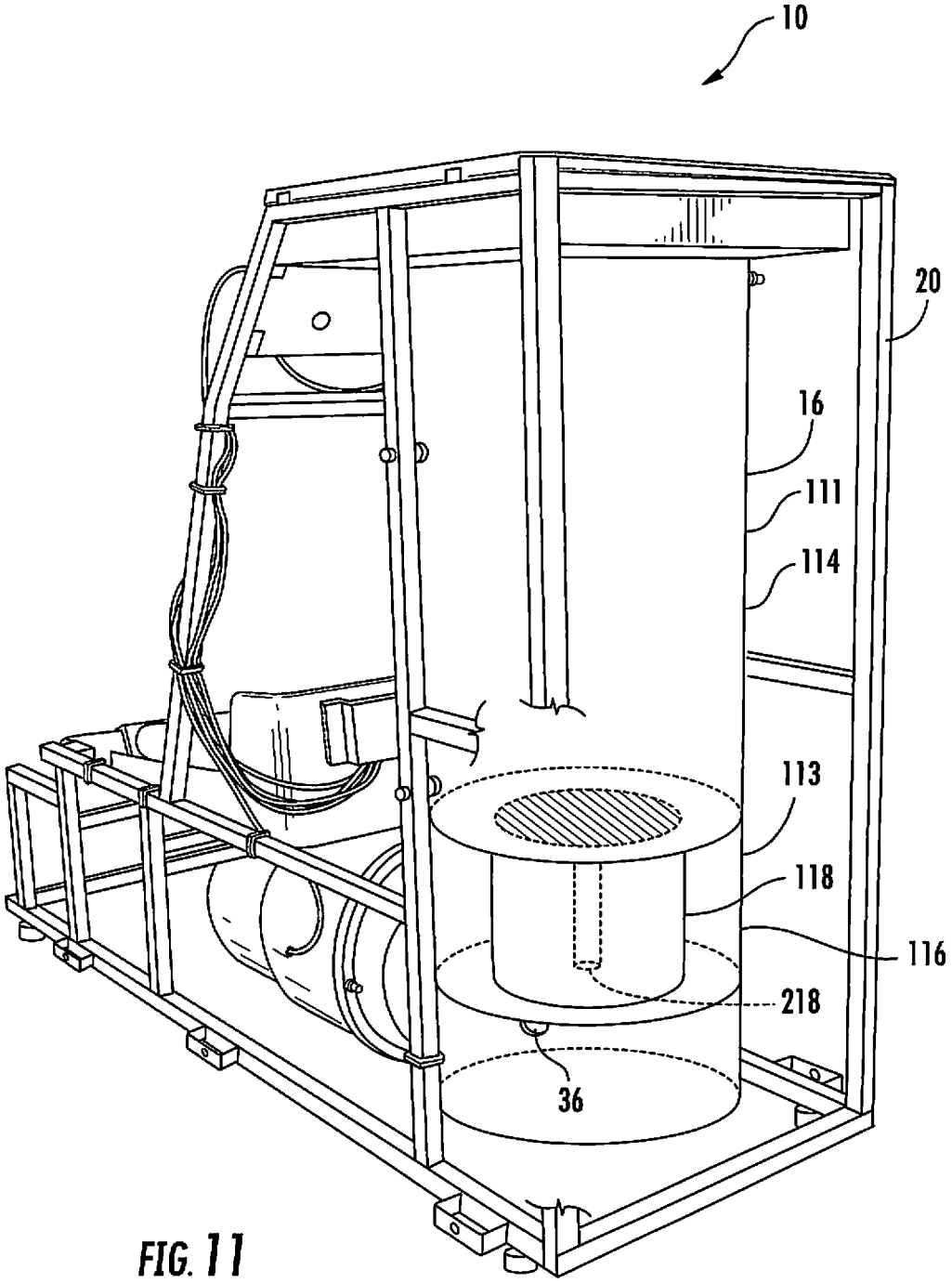
FIG. 11 shows a perspective rear view of a shoe cover removal apparatus including a first sub-chamber and a second sub-chamber according to another embodiment of the invention.
Figure 12:
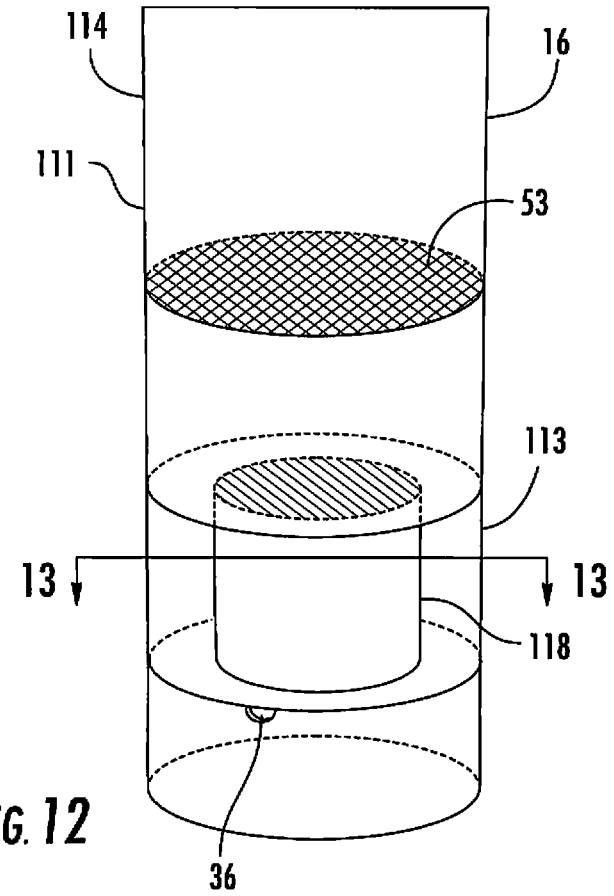
FIG. 12 shows the interior of a primary chamber including a first sub-chamber and a second sub-chamber according to an embodiment of the invention.
Figure 13:
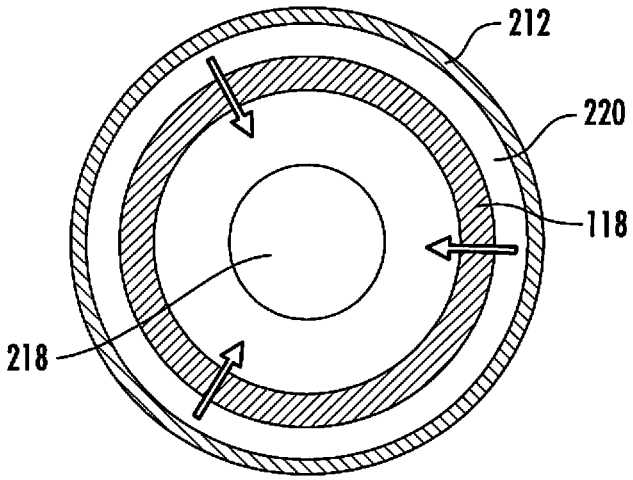
FIG. 13 shows a cross-sectional view of a primary chamber holding a cylindrical filter according to an embodiment of the invention.

In a related embodiment shown in FIGS. 11-12, the first sub-chamber 114 of the primary chamber 16 is subdivided into an upper portion 111 for receiving removed shoe covers and housing collection container 52, if applicable. A lower portion 113 of the first sub-chamber 114 is for housing a filter 118, preferably a HEPA filter, to remove dirt, dust, germs, bacteria, fungus, viruses, toxins, drugs, small particulate matter, and other contaminants from the materials being sucked through the container 52 and/or screen 53. The second sub-chamber 116 is for receiving filtered air through an exchange portal 218 between the first sub-chamber 114 and the second sub-chamber 116 and connecting the first sub-chamber 114 to the output portal 36 of the primary chamber 16. FIG. 13 shows a cross-sectional view cut along line A-A shown in FIG. 12. Air and any debris moves in the direction of the arrows from cavity 220 into the filter 118. Substantially purified air then flows from the interior of the filter 118 through the exchange portal 218.

Figure 8:
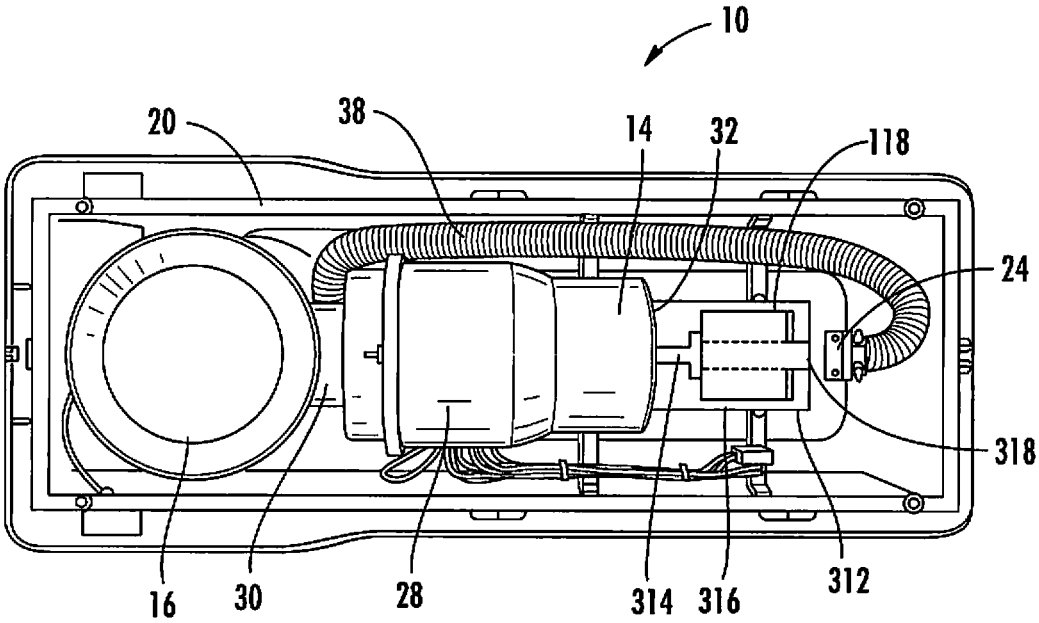
FIG. 8 shows a bottom view of a shoe cover removal apparatus that includes a housing for a filter according to another embodiment of the invention.

In another embodiment shown in FIG. 8, an apparatus 10 is shown including a trough 12, a vacuum device 14, a primary chamber 16, an actuator 18, and a frame 20. The vacuum device 14 includes a motor 28, a suction portal 30 and an exhaust portal 32. In this embodiment, rather than including a filter in the primary chamber 16, a filter housing 312 is attached to the exhaust portal 32 of the vacuum device 14. The housing 312 is for attaching a filter, preferably a HEPA filter, so that exhaust gas and any associated debris and/or contaminants may be filtered prior to exiting the apparatus 310. In the embodiment shown in FIG. 8, the apparatus 310 includes an attachment interface 314 for attaching a HEPA filter within the housing 312. As with embodiments discussed above, in one embodiment, gas and any debris moves from an open cavity 316 into the filter 118. Purified gas then flows from the interior of the filter 118 through the exit portal 318 to the environment.

All of the spaces that are directly and indirectly connected to vacuum device 14 are preferably substantially hermetically sealed so that the operation of the vacuum device 14 is effective to suck shoe covers off of the shoe of a user and to prevent debris and contaminants from escaping the apparatus. Gaskets are preferably used with all interconnections of various portions of apparatus (10, 110, 210, and 310). Such gaskets are preferably made from synthetic rubber, synthetic rubber and flouropolymer elastomer (e.g., Viton® from DuPont Performance Elastomers, LLC, of Wilmington, Del.), polysiloxane, or flouropolymers (e.g., Teflon® from E. I. du Pont de Nemours and Company, of Wilmington, Del.). The primary chamber 16 is preferably made from metal or a metal alloy (e.g., aluminum, steel, iron). The trough 12 and the shell 56 are preferably made from polymers such as polyvinylchloride (PVC). However, in various embodiments of the invention, other suitable materials may be used for the system components.

Figure 7:
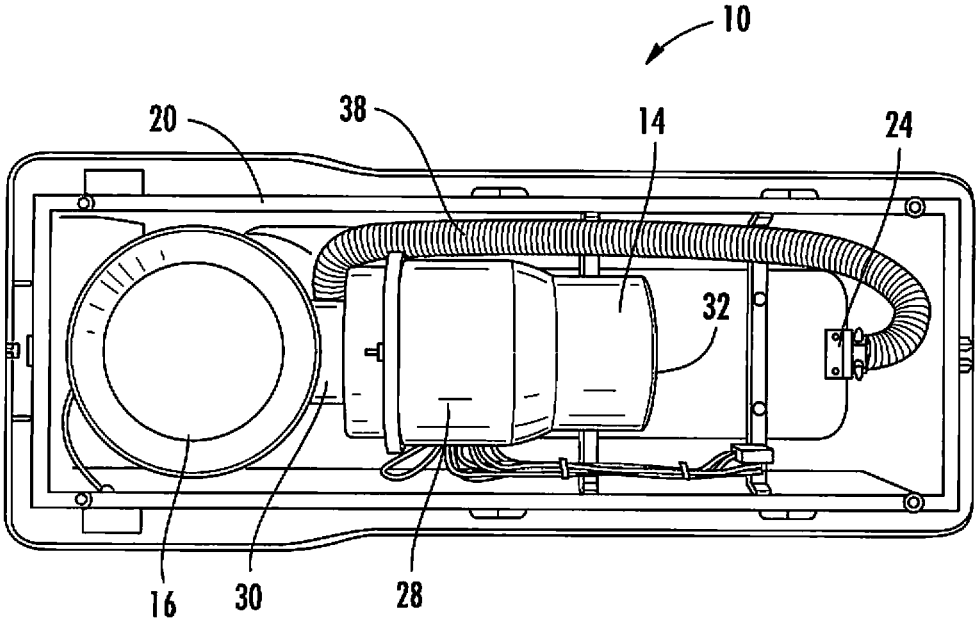
FIG. 7 shows a bottom view of a shoe cover removal apparatus according to an embodiment of the invention.
Figure 14:
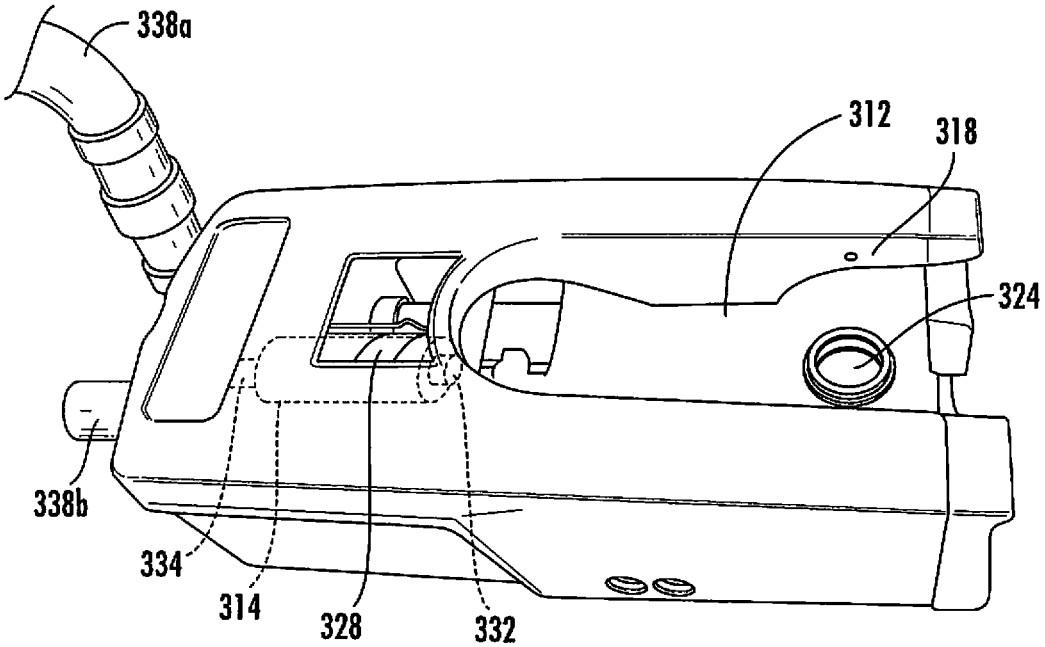
FIG. 14 shows a perspective top view of a shoe cover removal apparatus including a trough according to an embodiment of the invention.
Figure 15:
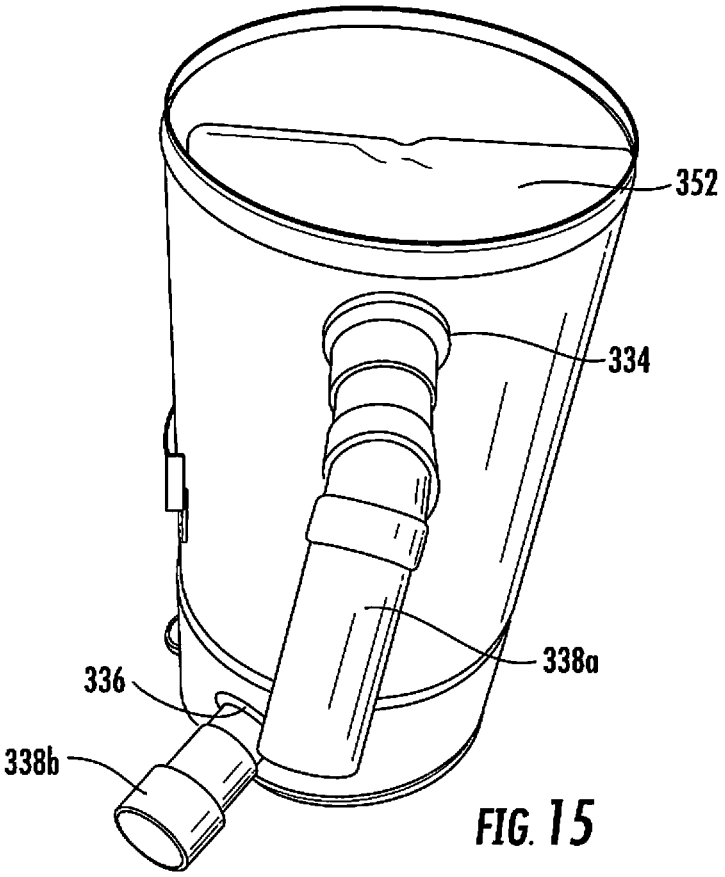
FIG. 15 shows a front perspective view of a primary chamber according to an embodiment of the invention.
Figure 16:
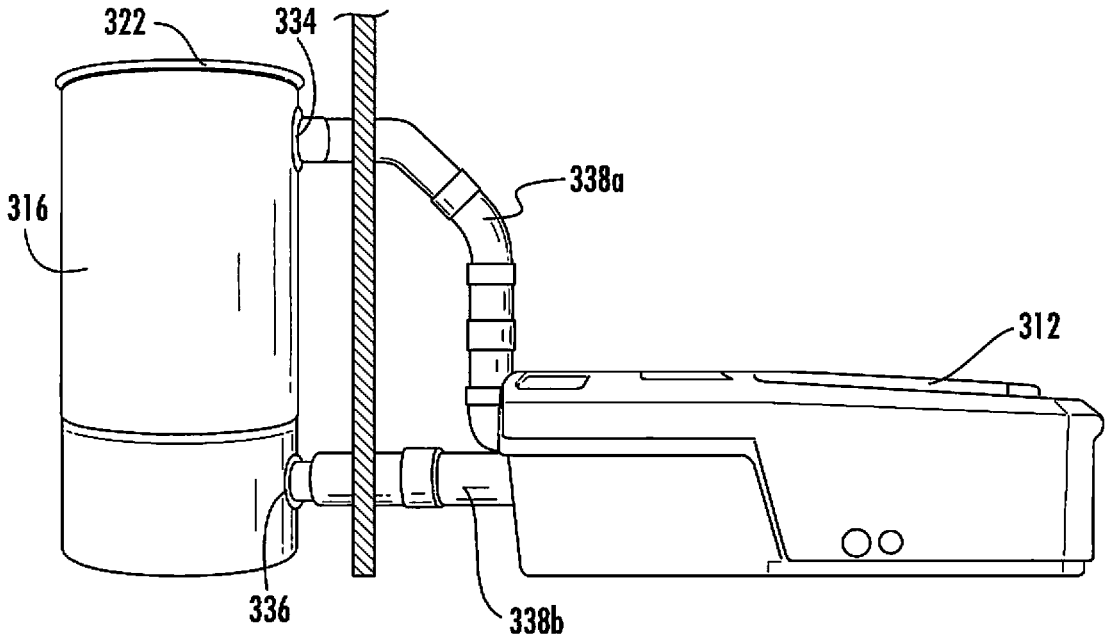
FIG. 16 shows a side view of a shoe cover removal apparatus including a trough disposed remotely from the primary chamber according to an embodiment of the invention.

In another embodiment shown in FIGS. 14-16, a primary chamber 316 may be located remotely from a trough 312 so that the removed shoe covers collected by the apparatus 310 are stored at a distance sufficient to prevent the debris and contaminates on the removed shoe covers from being stored in an area that is desired to be as clean as possible. For example, the trough 312 may be located in a "clean room" and the primary chamber 316 may be located in a separate room preferably adjacent the "clean room." Thus, the shoe cover of a user is sucked through a removal portal 324 of the trough 312 in the "clean room" and travels through a flexible hose 338 to a primary chamber 316 that is located remotely from the trough 312 so that the contaminated shoe covers are collected and stored in an area other than in the immediate location of the "clean room." The flexible hose 338 connecting the trough 312 to the primary chamber 316 may be a flexible vacuum hose as shown in FIGS. 7-8. In a preferred embodiment, the flexible hose 338 is two inch diameter flexible polyvinyl chloride tubing (PVC).

Similar to the device shown in FIGS. 1-7, the trough 312 includes a removal portal 324, a vacuum device 314, and an actuator 318. The vacuum device 314 includes a motor 328, a suction portal 330, and an exhaust portal 332. The primary chamber 316 includes an input portal 334 and an output portal 336. A collection container 352 fits within the primary chamber 316. A lid 322 is provided for providing access to the collection container 352, and the connection between the primary chamber 316 and lid 322 is preferably substantially hermetically sealed when the lid 322 is in a closed position. The collection container 352 is porous, allowing for air to flow through the container 352 but prohibiting shoe covers from escaping the container 352. The container 352 may be removed from the primary chamber 316 when the lid 322 is in an open position, thereby facilitating the removal of shoe covers from the apparatus 310. The container 352 may also be replaceable so that new clean containers 352 may be inserted into the primary chamber 316 for collecting the removed shoe covers.

As shown in FIG. 16, the removal portal 324 is connected to the input portal 334 of the primary chamber 316 using the flexible hose 338*a*. The output portal 336 of the primary chamber 316 is connected to the suction portal 330 of the vacuum device 314 using the flexible hose 338*b*. All of these connections are preferably substantially hermetically sealed when the vacuum 314 is activated by the actuator 318. The actuator 318 is triggered by the placement of a user's foot in the trough 312 and the activation of the vacuum device 314 causes a shoe cover to be removed from the shoe of the user. The shoe cover is sucked through the removal portal 324 and into the collection container 352 of the primary chamber 316. In one embodiment, the container 352 is a porous disposable, replaceable bag, similar to a vacuum cleaner bag.

In a related embodiment, a plurality of troughs 312 may be connected to one or more primary chambers 316. For example, as shown in the schematic diagram in FIG. 17, a plurality of troughs 312 are located in a plurality of "clean rooms" 360. After being sucked through a removal portal 324 of one of the troughs 312, the removed shoe covers travels through the flexible hose 338 to a primary chamber 316 located in a chamber room 362 separated from the clean rooms 360. In this embodiment, the primary chamber 316 may have multiple input portals 334 for connecting the plurality of troughs 312, but the flexible hoses 338 of the plurality of troughs 312 are preferably interconnected so that each of the removed shoe covers enters the primary chamber 316 through the same input portal 334.

Figure 17:
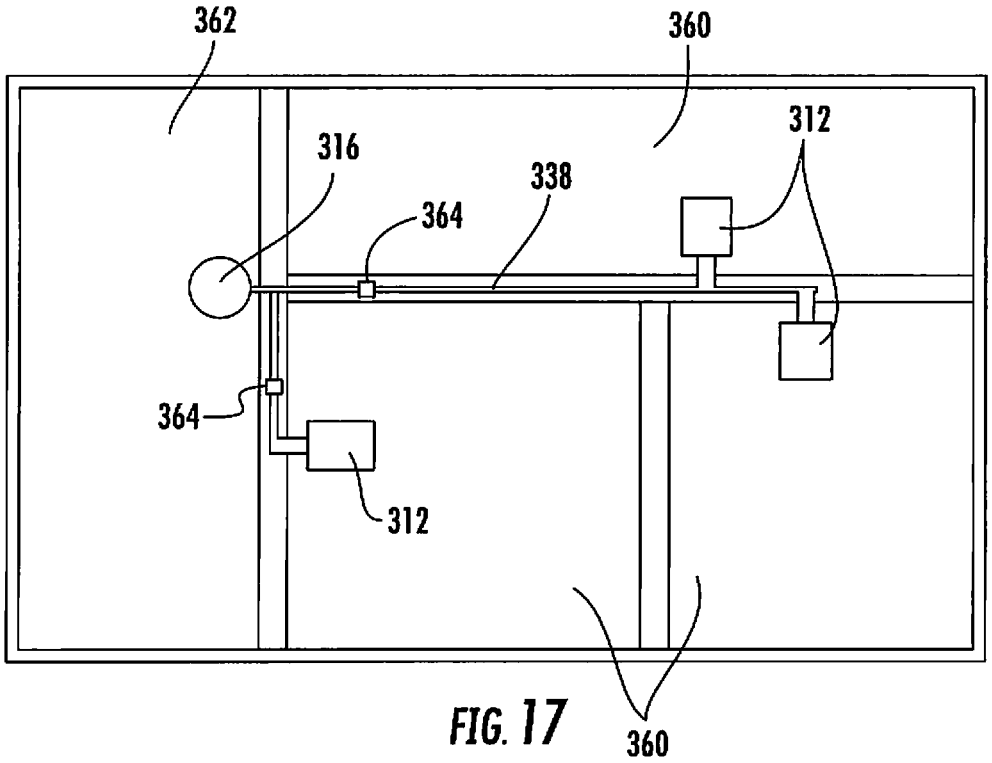
FIG. 17 shows a overhead schematic diagram of a shoe cover removal system including a primary chamber and a plurality of troughs according to an embodiment of the invention.

In this embodiment, the vacuum device 314 is preferably disposed at the primary chamber 316 as opposed to being part of trough 312. However, in some embodiments, the troughs 312 may also include their own vacuum devices for additional power. The vacuum device 314 at the primary chamber 316 is in rest mode until an actuator 318 at one of the troughs 312 detects when a user places a shoe in the trough 312. The removal portals 324 of the troughs may be substantially sealed when in rest mode and then unsealed when the trough 312 is activated. When a user places the shoe into one of the troughs 312, the actuator sends a signal to the vacuum device 314 causing power to flow to the particular trough 312 that detected the user. After the vacuum device 314 is activated, a vacuum is created within the trough 312 at the removal portal 324, such that the shoe cover is removed from the shoe of the user and sucked through the removal portal 324 and into the flexible hose 338. The flexible hose 338 shown in FIG. 17 is in-wall PVC tubing. The removed shoe covers then travel through the in-wall tubing 338 to the collection container 352 of the primary chamber 316. Booster motors 364 may be provided within the in-wall tubing 338 between the removal portal 324 of a trough 312 and the primary chamber 316 for providing enhanced suction to a removal portal 324.

The foregoing description of preferred embodiments for this invention has been presented for purposes of illustration and description. They are not intended to be exhaustive or to limit the invention to the precise form disclosed. Obvious modifications or variations are possible in light of the above teachings. For example, a suitable filter may be provided at various positions not particularly disclosed herein which are within the flow path of the automatic shoe cover remover. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A method of using an apparatus for removing a shoe cover from a user's shoe, the apparatus comprising an open trough for receiving a user's shoe, the trough including sidewalls, an open top area defined by upper edges of the sidewalls, and a bottom surface; a removal portal located within the trough; a vacuum including a motor, a suction portal, and a exhaust portal; a primary chamber including a lid, a primary chamber input portal, and a primary chamber output portal, the primary chamber for receiving and retaining removed shoe covers, the primary chamber input portal being connected to the removal portal, and the primary chamber output portal being connected to the suction portal of the vacuum; an actuator that it is activatable by the placement of an object in the trough, and a first filter for removing debris and other contaminants from gas passing through the apparatus when the vacuum is activated, wherein the first filter comprises a porous collection container removably located in the primary chamber, the porous collection container for collecting removed shoe covers and preventing removed shoe covers from obstructing the primary chamber output portal, the method comprising the steps of:

(a) inserting a shoe at least partially covered by a shoe cover into the trough such that the shoe is adjacent the removal portal;

(b) detecting the shoe when it placed into the trough using a detection system;

(c) actuating the vacuum device such that it creates a vacuum in the primary chamber and at the removal portal;

(d) removing the shoe cover from the shoe via the removal portal with the vacuum created at the removal portal;

(e) receiving and retaining the shoe cover in the primary chamber; and (f) removing the porous collection container from the primary chamber for disposal of the removed shoe covers.

2. The method of claim 1, further comprising the step of, after step (e):

(g) removing the shoe from the trough; and (h) detecting that the shoe is not longer located within the trough; and (i) deactuating the vacuum device.

3. The method of claim 1, wherein the detection system is a motion detection system and the detecting step comprises detecting motion of the shoe entering the trough.

4. The method of claim 3, wherein the motion detection system is an infrared light detection system.

5. The method of claim 1 wherein the removal portal is unobstructed above a top portion of the removal portal and step (d) further comprises the shoe cover being removed from the shoe directly through the top portion of the removal portal.

6. The method of claim 1, wherein the apparatus further comprises a second filter, wherein the second filter is a high efficiency particulate air filter.

7. The method of claim 1, wherein the apparatus further comprises a second filter, wherein the second filter is a cylindrical filter located in the primary chamber.

* * * * *